US005720161A

United States Patent [19]

Liedgens

[11] Patent Number: 5,720,161

[45] Date of Patent: Feb. 24, 1998

[54] SLIVER CAN, CAN CHANGER AND PALLET

[75] Inventor: Hans-Peter Liedgens, Mönchengladbach, Germany

[73] Assignee: W. Schlafhorst AG & Co., Moenchengladbach, Germany

[21] Appl. No.: 322,614

[22] Filed: Oct. 13, 1994

[30] Foreign Application Priority Data

Oct. 15, 1993 [DE] Germany ..... 43 35 173.5

[51] Int. Cl.[6] ..... D01H 9/10; D01H 9/14

[52] U.S. Cl. ..... 57/281; 19/159 A; 57/90; 108/55.3; 198/465.2; 198/803.01; 206/386

[58] Field of Search ..... 57/90, 281; 19/159 A; 206/386; 108/55.3, 55.5; 198/465.2, 465.3, 803.01, 803.2

[56] References Cited

U.S. PATENT DOCUMENTS

| | | | |
|---|---|---|---|
| 3,418,084 | 12/1968 | Allington | 198/465.2 |
| 3,654,875 | 4/1972 | Vik | 108/55.3 X |
| 4,083,170 | 4/1978 | Raasch | 57/281 |
| 4,253,570 | 3/1981 | O'Connor et al. | 206/386 X |
| 4,516,677 | 5/1985 | Rowland et al. | 108/55.3 X |
| 4,653,263 | 3/1987 | Stahlecker et al. | 57/281 X |
| 4,660,370 | 4/1987 | Matsui et al. | 57/281 |
| 4,972,669 | 11/1990 | Raasch | 57/281 |
| 4,998,406 | 3/1991 | Raasch | 57/281 |
| 5,086,927 | 2/1992 | Bach et al. | 108/55.5 X |
| 5,138,828 | 8/1992 | Stahlecker | 57/281 |
| 5,144,897 | 9/1992 | Avery | 108/55.3 |
| 5,253,745 | 10/1993 | van den Bergh et al. | 198/803.01 |
| 5,333,359 | 8/1994 | Kroupa | 57/281 X |
| 5,390,484 | 2/1995 | Schwalm | 57/281 |
| 5,391,045 | 2/1995 | Raasch et al. | 57/281 X |

FOREIGN PATENT DOCUMENTS

| | | | |
|---|---|---|---|
| 0427044 | 5/1991 | European Pat. Off. . | |
| 525447 | 2/1993 | European Pat. Off. | 57/281 |
| 1268059 | 5/1968 | Germany | 108/55.3 |
| 2754914 | 6/1979 | Germany . | |
| 3440598 | 5/1986 | Germany | 57/281 |
| 3841464 | 6/1990 | Germany . | |
| 4018088 | 1/1991 | Germany . | |
| 4015826 | 2/1992 | Germany . | |
| 4204044 | 2/1993 | Germany . | |
| 4130463 | 3/1993 | Germany . | |
| 4231697 | 4/1993 | Germany . | |
| 4323726 | 7/1993 | Germany . | |
| 49-12128 | 3/1974 | Japan | 57/281 |
| 302106 | 12/1928 | United Kingdom | 19/159 R |

*Primary Examiner*—William Stryjewski
*Attorney, Agent, or Firm*—Herbert L. Lerner; Laurence A. Greenberg

[57] ABSTRACT

A sliver-processing system has at least one sliver-processing textile machine with at least one work station, at least one discharge station for filled sliver cans and a discharge station for empty cans. A sliver can assembly includes a sliver can with a round cross section commuting back and forth between the at least one discharge station for filled sliver cans and the discharge station for empty sliver cans. A polygonal pallet is connected to the can and has a position for a starting sliver end being definitively fixed relative to the can and relative to the pallet for automatic insertion at the at least one work station. A can changer for manipulating and transporting the sliver cans includes a can transport vehicle having parking places for the sliver cans, a changer mechanism for replacing the cans at the work stations and transfer places for the cans, and pushers for displacing the cans relative to one another on the parking places for reordering a configuration of the cans when the cans are picked up or delivered. The cans always maintain defined positions on the pallets relative to the insertion of the sliver upon transfer from one position to another. A pallet for receiving a round can includes a polygonal outer periphery. The round can is secured in a defined position relative to the polygonal outer periphery.

17 Claims, 7 Drawing Sheets

1
2
3
4
5
6
6a
7
8
9
10
11
12
13
14
15
16
17
18
19
20
21
28
30
35
36
37
40
41
42
43
44
46
47
48
49
50
51
52
53
54
55
56
57
58
59
60
61
62
63
64
65
66
67
68
69
70

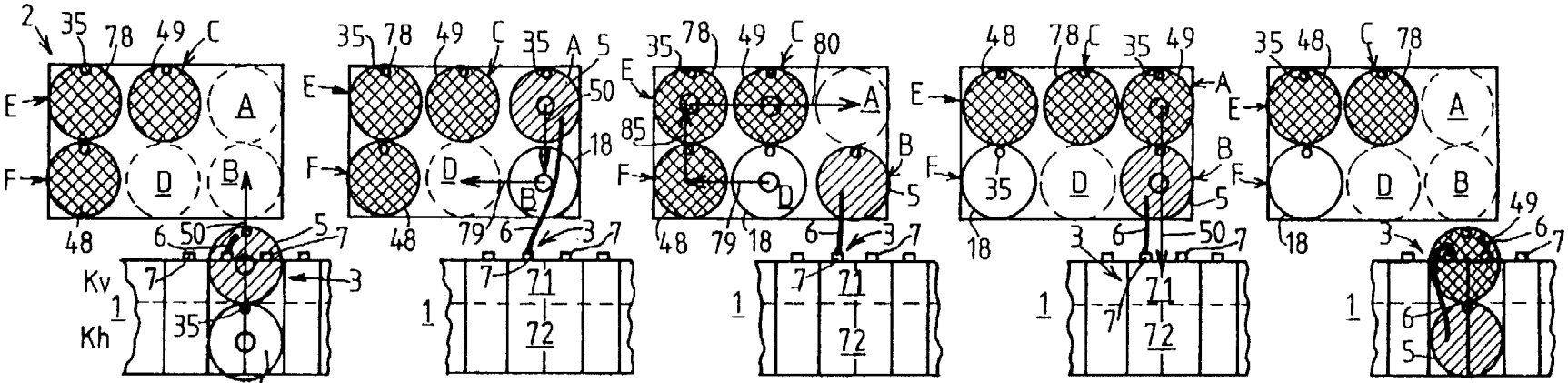
FIG. 7a
FIG. 7b
FIG. 7c
FIG. 7d
FIG. 7e
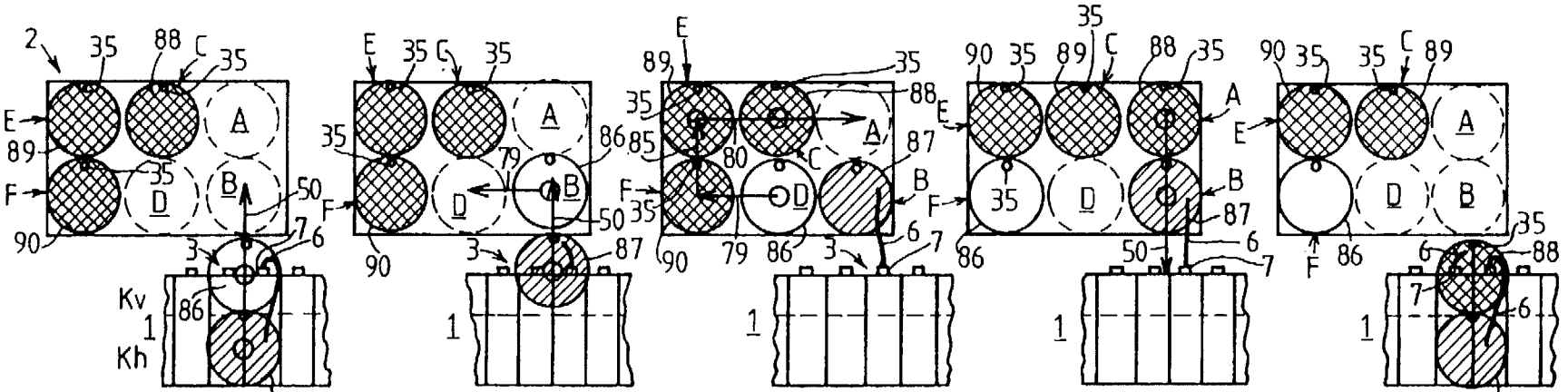
FIG. 8a
FIG. 8b
FIG. 8c
FIG. 8d
FIG. 8e

SLIVER CAN, CAN CHANGER AND PALLET

BACKGROUND OF THE INVENTION

1. Field of the Invention

The invention relates to a round sliver can which commutes back and forth between a discharge station for filled sliver cans of at least one sliver-processing textile machine and a discharge station for empty cans, wherein a starting end of the sliver is definitively fixed with respect to the can, for insertion at a work station of a sliver-processing textile machine.

Sliver can handling and transport has already been automated to such an extent that human intervention is no longer necessary. Can transport vehicles are capable of exchanging empty cans for filled cans at the work stations of sliver-processing textile machines and are optionally capable of inserting the sliver at the work station. The empty cans are transported to a discharge station and unloaded there, and then the can transport vehicle picks up automatically filled sliver cans at a sliver-producing textile machine. While by now the automatic changing of the cans presents no problems, the insertion of the sliver at a work station involves major expense for technical control means, as may be learned from German Published, Non-Prosecuted Application DE 42 04 044 A1, corresponding to U.S. Pat. No. 5,293,739. The sliver must already be furnished to the cans in a defined position at the textile machine that fills the cans. That makes it possible to subsequently find the sliver for the automatic insertion. As a rule, the sliver is furnished on the outer wall of a can in a clamp. When a can change takes place at a work station, assurance must then be provided that the can is positioned in such a way that the sliver being kept ready at the terminal can also in fact be engaged by the automatic manipulator for insertion of the sliver. Due to the requisite turning in order to orient the cans for the application of the sliver, and the correct positioning upon transfer to a work station, round sliver cans require their own positioning device with a sensor in order to ascertain the location of the starting end of the sliver, as may be learned from German Published, Non-Prosecuted Application DE 41 30 463 A1, corresponding to U.S. Pat. No. 5,311,645.

SUMMARY OF THE INVENTION

It is accordingly an object of the invention to provide a sliver can, a can changer and a pallet, which overcome the hereinafore-mentioned disadvantages of the heretofore-known products and devices of this general type, which simplify the can changing process in such a way that the sliver can always assumes the position intended for the corresponding operation without further straightening upon transport and in manipulation, and which do so upon insertion of the sliver in particular.

With the foregoing and other objects in view there is provided, in accordance with the invention, in a sliver-processing system having at least one sliver-processing textile machine with at least one work station, at least one discharge station for filled sliver cans and a discharge station for empty cans, a sliver can assembly comprising a sliver can with a round cross section commuting or running back and forth between the at least one discharge station for filled sliver cans and the discharge station for empty sliver cans; and a polygonal pallet being connected to the can and having a position for a starting sliver end being definitively fixed relative to the can and relative to the pallet for automatic insertion at the at least one work station.

According to the invention, each can is connected to a pallet, and if the can has a clamp for fixing the starting end of the sliver, the can is set on the pallet in such a way that this clamp always assumes a defined position relative to the pallet. If the cans themselves have no clamp for fixing the starting end of the sliver that is to be inserted at a work station, then it is possible to equip the pallet with a clamp for the starting end of the sliver. This clamp may, for instance, be secured to a bar that has a defined height, which is adapted to the operative range of an automatic sliver inserter. This bar will always be secured to a previously defined point on the pallets. The pallets have a simple surface shape and can be produced inexpensively, for instance as an injection molded part made of wear-resistant high-impact plastic. The term "polygonal pallets" is understood to mean pallets with multiple sides. The pallets are polygonal, or in other words have a polygonal outer periphery. The outer periphery has a plurality of sides that extend at an angle to one another, thus enabling form-locking intercalation into a transport and manipulation system. A form-locking connection is one which connects two elements together due to the shape of the elements themselves, as opposed to a force-locking connection, which locks the elements together by force external to the elements.

In accordance with another feature of the invention, the starting end of the sliver assumes a defined position relative to the pallet, and the pallet only needs to be introduced into the system the first time in such a way that when set down on the parking place at a work station, it assumes the position intended for the automatic insertion of the starting end of the sliver.

In accordance with a further feature of the invention, upon transfer from one position to another, the can always maintains defined positions in the system with respect to the insertion of the sliver. This is always attainable with a polygonal pallet, because one side of the pallet can be disposed as a preferred side for maintaining a defined pallet position. Conversely, with a round can, an orientation point for the fixation of a defined position in the system is lacking as a rule, unless expensive optical search systems are installed, for instance to locate the sliver clamp and to orient the can from those signals.

Once a can with its pallet has been brought into the system in such a way that it assumes a position at a work station which enables the automatic insertion of the starting end of the sliver, then it will always assume this position again and again at every operating station regardless of the number of can changing operations. This maintenance of the defined positions in the system cannot be interrupted, unless intervention is carried out intentionally.

In accordance with an added feature of the invention, the sliver cans are detachably connected to the pallets. This affords the possibility of replacing damaged cans and reusing the pallets. It also affords the possibility of equipping already existing cans in a transport system with the use of the pallets without having to procure new cans. The connection between the pallet and the can may, for instance, be carried out by means of a detachable screw connection or by snapping the lower rim of the can into the pallet.

The shape of the pallet depends on the intended application. It is initially attractive to give the pallets a square shape.

In accordance with an additional feature of the invention, only two opposed sides are equipped with mirror-symmetrical means for form-locking connection of the pallets. In this way an unequivocal orientation of a pallet to a preferred side is possible. This is also true if, in accordance with yet another feature of the invention, the pallets have the form of an equilateral polygon, such as an octagon. In an octagonal pallet, for instance, virtually no more space is required than that for a round can, which makes it easier to retrofit existing equipment originally intended for transporting and handling round cans, for instance on the turntables of the can filling stations. The advantage of the invention, that is the maintenance of the specified orientation of a can with respect to the insertion of the sliver, can still be fully exploited.

In accordance with yet a further feature of the invention, the pallets have an essentially rectangular outline. Then, for the orientation of the pallets, this affords the possibility of selecting a short side or a long side as the preferred side for orienting the sliver starting end. In order to enable the pallets to be more easily manipulated and to allow them to slide past other pallets better during manipulation and during transport, the edges of the pallets are rounded or trimmed away diagonally. In the latter case, for instance, a pallet will have not four but eight corners. Cans that are standing on pallets offer the further major advantage of not touching one another during manipulation and during transport. This prevents damage to the sliver fixed to the can rim, for instance, or prevents it from being pulled out of the clamp again. Sliver extending over the can rim is also prevented from coming into contact with the sliver from other cans, which could either cause soiling or the wrong fibers in the yarn, or could even push the so-called head off the can.

Pallets with cans set on them further offer the capability according to the invention of coupling the pallets together. Means for form-locking connection of the pallets offer the capability of assembling a plurality of pallets into pallet trains, for instance, which are suitable for being transported over transport paths in a closed train of cans. The form-locking connection affords the opportunity of easy coupling of the pallets to one another and easy separation of the pallets from one another.

In accordance with yet an added feature of the invention, the means for form-locking connection of the pallets with one another are each disposed on two opposed sides of the pallets. Thus these sides each become preferred sides of the pallets, which can be used, for instance, to orient the pallets. It is of no importance for the sake of the invention whether with rectangular pallets, for instance, the means for form-locking connection are located on the short sides or the long sides of a pallet.

In accordance with yet an additional feature of the invention, particularly simple means for form-locking connection of the pallets include a gripper claw of hooklike cross section which can enter into operative connection with a mirror-symmetrical gripper claw of another pallet by fitting laterally into one another. The gripper claws serve as a guide when the cans are displaced at the discharge and filling stations, on the can transport vehicle and at the work stations, and also serve as means for engagement for manipulating the pallets. For instance, if two cans below two side by side work stations of a sliver-processing textile machine are disposed one after the other, as is the case, for instance, when can parking places in open-end rotor spinning machines are occupied, then the two pallets of the cans can be coupled together with the aid of the form-locking connection. This makes changing the can in the second row substantially easier, because as a result of the removal of the first can, the pallet with the second can behind it is already pulled out along with it and thus made accessible for a change.

In accordance with again another feature of the invention, the gripper claws on opposed sides of the pallet are oriented in opposite directions. If the gripper claws on the pallets were oriented in the same direction, there would be two different kinds of pallets and it would not be possible to couple identical pallets to one another. As a result of the claimed recessing of the pallet, each pallet can be coupled with another pallet.

In accordance with again a further feature of the invention, an underside or lower surface of the pallet is equivalent to a mirror-symmetrical recessing of a top side or upper surface of the pallet. Then the cans standing on the pallets can also be stacked one above the other. The top of a sliver can fits into the recess of the underside of one pallet. If a pallet is placed on a can in such a way that its edge fits into the recess of the pallet, then a can standing on the pallet can be securely stacked. While standing on the pallets, the cans can be transported and stacked with forklifts, for instance, or other handling devices. If the pallets are telescoped into one another with their gripper claws, then the can stacks are provided with a lateral hold as well. In order to set down the pallets with the sliver cans located on them, standardized Euro pallets can also be used, for instance. Stacking filled or empty sliver cans one above the other has heretofore either been impossible, or has resulted in very unstable storage. The ability to stack filled sliver cans in a space-saving way makes it possible to meet the demand when there are fluctuations in production, or gives the yarn a chance to rest in the cans.

In accordance with again an added feature of the invention, in the event that the sliver can offers no opportunity to deposit the starting end of the sliver on the can, the pallets are equipped with a retainer for the sliver. This assures that the starting end of the sliver can always is found at the same place on all of the pallets by a manipulator device for automatic insertion of the sliver at a work station.

In accordance with again an additional feature of the invention, there are provided encoding means. The encoding means may be a bar code, a magnetic tape or a random access memory, that is a read-write memory. Color encoding means or other possible encoding means are also conceivable. As compared with encoding means for a can, the encoding means for a pallet offer the advantage of ensuring that the pallets always have a preferentially oriented edge for the sake of fixing the position of the sliver. This makes it easier to find the encoding means. When a can has encoding means the can must first be brought into a suitable position for the reader unit if the encoding means are to be read, or the encoding means must be disposed over the entire periphery of the can, as is known, for instance, from German Published, Non-Prosecuted Application DE 27 54 914 A1. While this is the case as a rule for the pallet, it suffices to place the code at some preferred point, such as at the location where the starting end of the sliver is located.

The encoding means, for instance in a read-write memory, offer the opportunity of storing in memory essential production data for sliver production, data on the sliver material in the cans, and location data, and of recording every manipulation of the cans. Data can be read, erased and rememorized in reader units that are disposed at the transfer places of the cans, in other words on the transport vehicle and at the can parking places and at the work stations of the sliver-processing textile machine. Thus the contents of a can can be followed without any gaps from the sliver-producing textile machine to the final product, and therefore the required data for monitoring or for productivity determination can also be ascertained.

With the objects of the invention in view, there is also provided a can transport vehicle, comprising parking places for the cans, a changer mechanism for changing the cans at the work stations and at can transfer places, and pushers for displacing the cans relative to one another on the parking places of the can transport vehicle in order to reorder a configuration of cans when cans are picked up or delivered. The gripper claws of the cans that are to be changed at the work stations mesh with one another. Cans standing on pallets are substantially easier to manipulate than round individual cans. Above all, it is possible to manipulate the cans at their base, without threatening the stability of the can positions during manipulation and during transport.

Conversely, round cans must either be engaged all the way around or lifted from above with gripper claws. However, lifting them from above can cause problems, particularly with highly fluffy yarns that swell out over the rim of the can. The danger exists that layers of sliver swelling out beyond the can rim will be pushed off during the manipulation. This danger does not exist when cans that stand on pallets are manipulated.

Cans without pallets can only be poorly transported over relatively long distances unless there is a suitable can transport vehicle. Empty cans above all are threatened with tilting, because of their unfavorable center of gravity. The pallet according to the invention offers the capability of transporting cans even with different transport devices than can transport vehicles. By coupling a plurality of pallets together to make trains, space-saving and more-reliable transport of the cans can be made possible, and the encoding means on the pallets enables reliable delivery to an intended location.

In accordance with another feature of the invention, there are provided read and/or write devices for reading and/or applying encoding means, being disposed at the transfer places for the cans on the transport vehicle and at the parking places for the cans at the work stations.

In accordance with a further feature of the invention, there are provided transport devices, the pallets having gripper claws for coupling the pallets together and transporting the coupled-together pallets on the transport devices.

With the objects of the invention in view, there is additionally provided a pallet for receiving a round can, comprising a polygonal outer periphery, and means for securing a round can in a defined position relative to the polygonal outer periphery.

Other features which are considered as characteristic for the invention are set forth in the appended claims.

Although the invention is illustrated and described herein as embodied in a sliver can, a can changer and a pallet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 7*a*–7*e* are fragmentary, plan views illustrating a changing operation of an empty can in the from row of cans;

FIGS. 8*a*–8*e* is a view similar to FIGS. 7*a*–7*e* of the rear row of cans.

DESCRIPTION OF THE PREFERRED EMBODIMENTS

Figure 1:
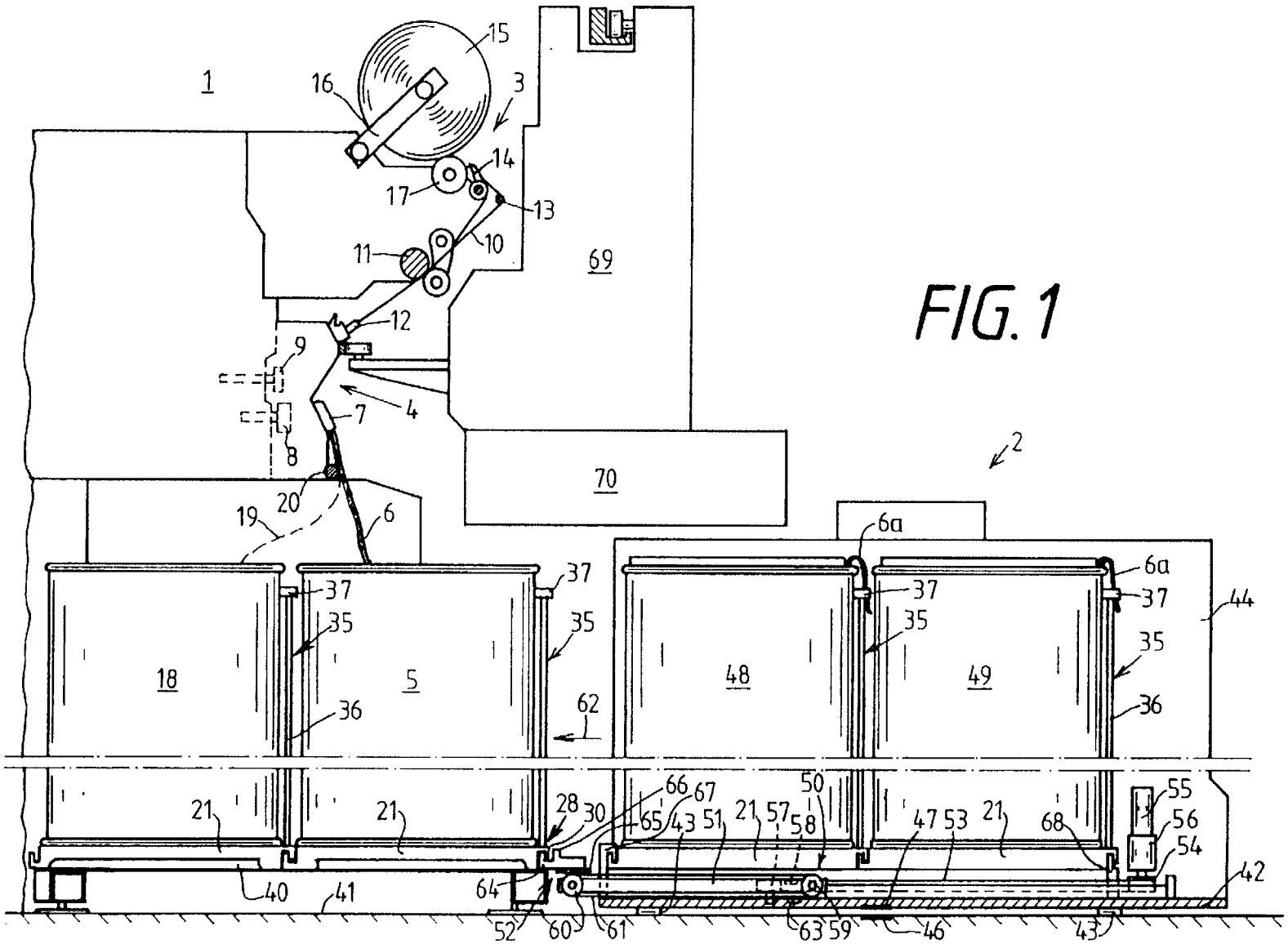
FIG. 1 is a fragmentary, diagrammatic, side-elevational view of a portion of a rotor spinning machine at a work station, with a can transport vehicle located in front of the work station in a position for changing.

Referring now to the figures of the drawing in detail and first, particularly, to FIG. 1 thereof, it is seen that reference numeral 1 indicates an open-end spinning machine, as an example of a sliver-processing textile machine. A side view of a spinning station 3 is diagrammatically shown with a can transport vehicle 2 which is positioned in front of it and is shown with a front part removed to allow can parking places to be seen. Only those characteristics that contribute to the invention are shown and described in each case.

One of the spinning stations 3 has been chosen as an example of the many spinning stations that are located side by side. At the spinning station, a sliver can 5 is located below a so-called spinning box 4 and sliver 6 is being drawn from the sliver can through a condenser 7. The spinning box 4 contains an opener device 8 which separates the drawn-in sliver 6 into individual fibers in a known manner, and yarn forming elements 9, that is a rotor in which a yarn 10 is spun from the separated fibers. The yarn is drawn from a draw-off tubule 12 of the spinning box 4 by a pair of draw-off rollers 11, it is deflected at a reserve hoop 13, and it is deposited on a cross-wound bobbin or cheese 15 by a yarn guide 14. The cheese 15 is carried by a cheese holder 16 and driven by a winding roller 17.

As a rule, the spinning stations are narrower than the sliver cans that furnish them with sliver. The cans have a diameter that is approximately equivalent to the width of two spinning stations that are located side by side. For this reason, the sliver cans that furnish the sliver are disposed one behind the other for two spinning stations which are located side by side. This is also the case for the open-end spinning machine 1. Therefore, the sliver can 5 furnishes sliver 6 to the spinning station 3, while a sliver can 18 in the spinning station behind it has run empty. This is indicated by an interrupted course 19 of sliver up to a deflection bar 20. The can transport vehicle 2 has positioned itself in front of the spinning stations, in order to replace the empty sliver can 18 with a filled can.

Figure 2:
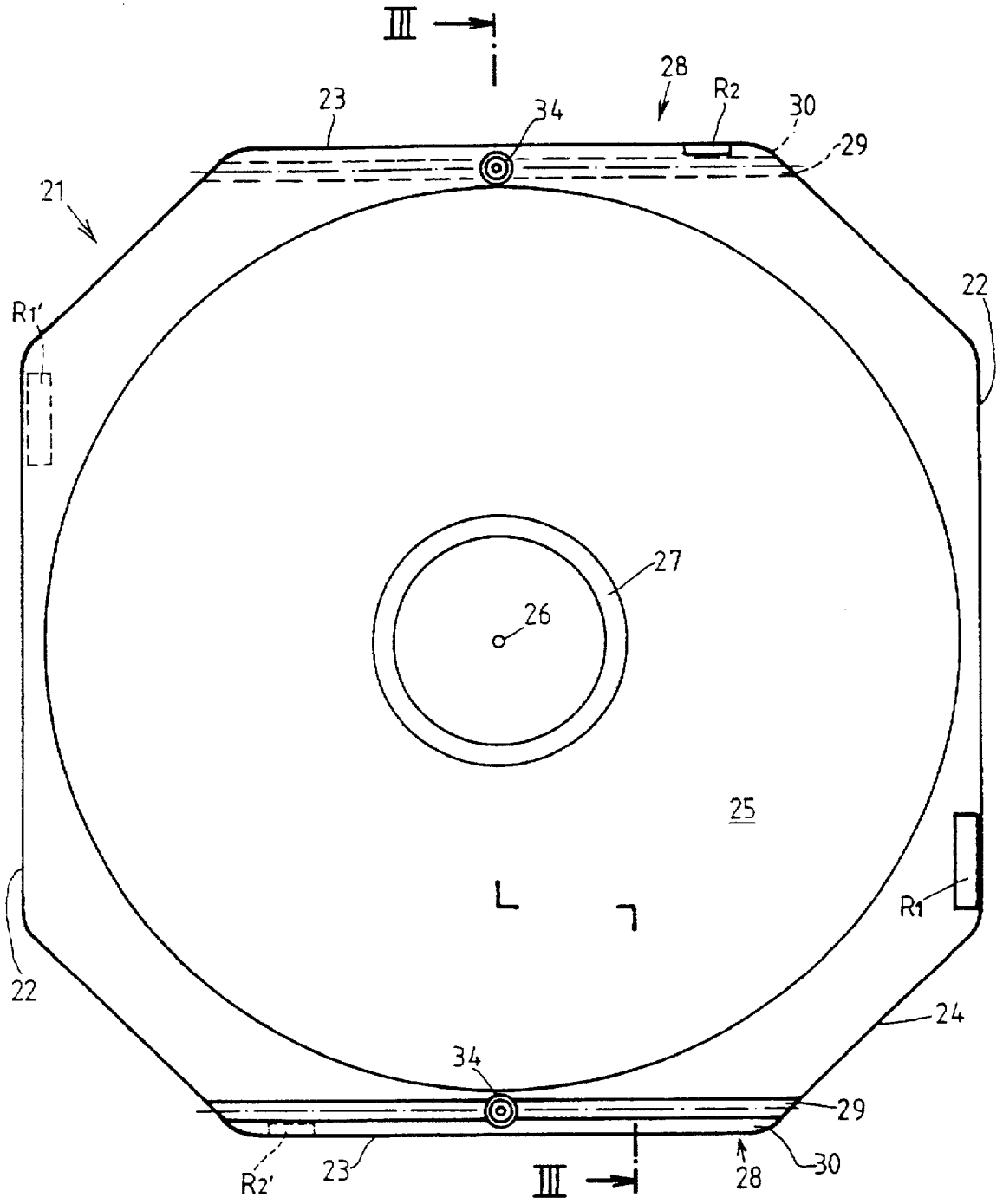
FIG. 2 is an enlarged plan view of a pallet according to the invention.
Figure 3:
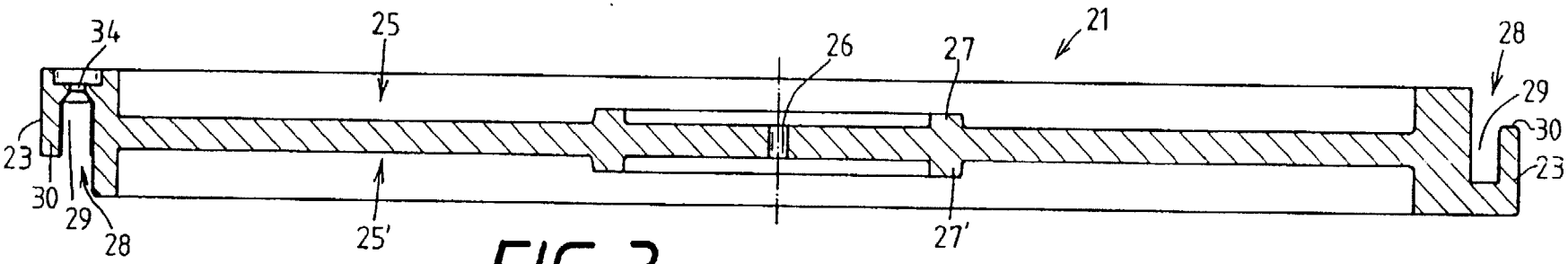
FIG. 3 is a sectional view of the pallet which is taken along the lines III—III of FIG. 2, in the direction of the arrows.

According to the invention, each of the sliver cans stands on a pallet 21. The shape of the pallets is shown in FIGS. 2 and 3. In FIG. 2, a plan view of a pallet is shown. Its rectangular shape can be seen, with long sides 22 and short sides 23. The pallet has edges 24 that are trimmed on the diagonal, in order to avoid the danger of tilting when the pallets are pushed together. The pallet has a circular recess 25 into which the sliver can fits with its base. In the center of the central recess, there is a centrally recessed support ring 27, for supporting the bottom of the inserted can. This ring 27 surrounds a fastening hole 26 for firmly screwing the can.

As can be seen from the sectional view of the pallet in FIG. 3, which corresponds to the course shown in FIG. 2, the upper and lower sides of the pallet are constructed identically but mirror-symmetrically. Thus after, the pallet has been inverted through 180°, a can can also be inserted into a recess 25'. Since the recesses are identical, it is moreover possible to stack cans one above the other, by taking a can and pallet set and placing the pallet of the can and pallet set on another can, in such a way that the upper rim of the other can is covered by the recess 25 of the pallet of the can and pallet set which is disposed on top. In the present exemplary embodiment, the recesses 25 and 25' have the same diameter. However, it would also be conceivable for one of the recesses to have a different diameter from the other. It would then be possible to secure cans of different diameters on one and the same pallet, once the preceding can is removed and after the new can is set on top once the pallet is inverted. Other fastening possibilities besides screwing may be provided, for instance clips or snap springs, although they are not shown herein. A support ring 27' is constructed symmetrically to the support ring 27.

As can be seen from the sectional view of FIG. 3, the pallet has been shown parallel to its long sides 22. Where the section line runs through narrow sides 23 of the pallet 21, so-called gripper claws 28 can be seen. The gripper claws include a groove 29 extending parallel to a short side 23, and therefore a rib 30 extends parallel on the outside. As can be seen from FIGS. 2 and 3, the gripper claws 28 on the short sides 23 are machined or formed into the pallet in mirror symmetry with one another. It is accordingly possible to join pallets together by sliding two gripper claws one into the another on the sides. This in turn offers the opportunity of disposing cans in rows one behind the other, as is also shown in the perspective view of FIG. 5 and in FIG. 9.

From the illustration of the pallet 21 in FIG. 2 it can be seen that the pallet is provided with encoding means. In the present exemplary embodiment, these encoding means are a random access memory, which is identified by reference symbols $R_1$, $R_1'$, $R_2$ or $R_2'$ depending on its possible disposition on the pallet. Reference symbol $R_1$ indicates a preferred configuration if the encoding means are to be processed by writing or reading devices that are disposed parallel to the direction of motion of the pallet. Reference symbol $R_1'$ indicates a possibility of disposing the RAM when the pallet has been inverted.

Another option for placement of the encoding means is suggested by reference symbols $R_2$ and $R_2'$. In that case, the encoding means are mounted on the side of the pallet that is accessible to the can handling device in each case. The encoding means may then already be read by a sensor disposed on the can transport vehicle, for instance if the vehicle has positioned itself in front of a workstation of the textile machine in order to carry out a can change.

Figure 4:
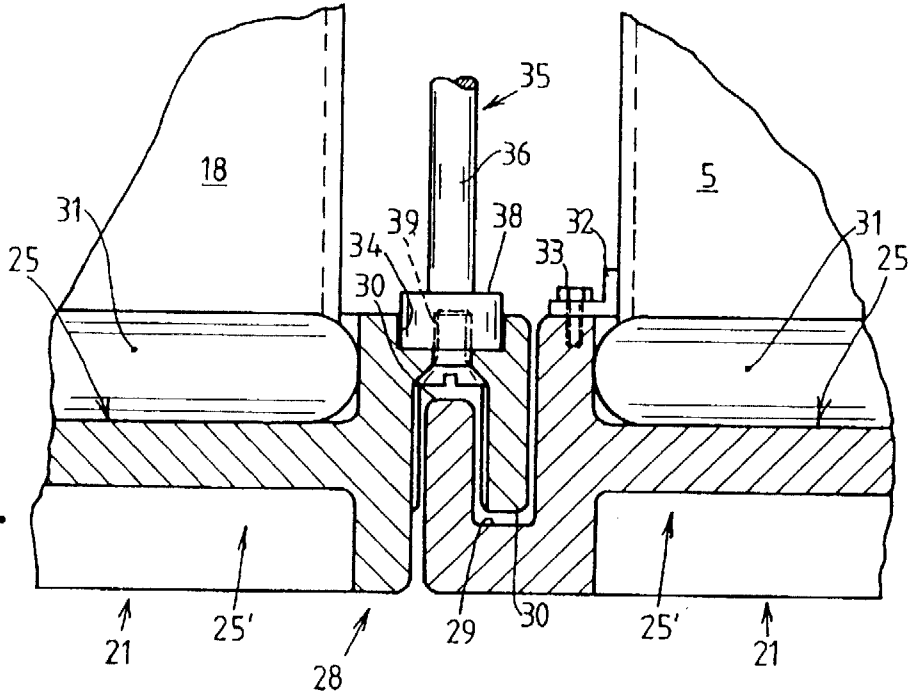
FIG. 4 is a fragmentary, sectional view of two meshing gripper claws of two pallets.

The fragmentary view of FIG. 4 shows the gripper claws of two coupled-together pallets being thrust one into the other, for example the pallets with cans 5 and 18 in the spinning machine 1.

As can be seen from FIG. 4, the cans 5 and 18 each have a base 31 which rests in the recesses 25 of a respective one of the pallets 21 assigned to each of them. In the present exemplary embodiment, the base 31 of the can 5 is kept in its position by an angle profile section 32, which is secured to the short side 23 by a screw 33. This is merely one exemplary embodiment of how a can can be secured to a pallet in some other way than being screwed at its bottom.

Figure 4A:
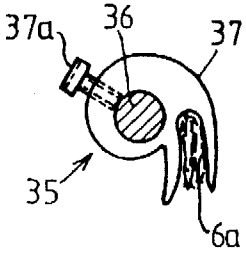
FIG. 4*a* is an elevational view of a sliver retainer with a starting end of the sliver being clamped.
Figure 5:
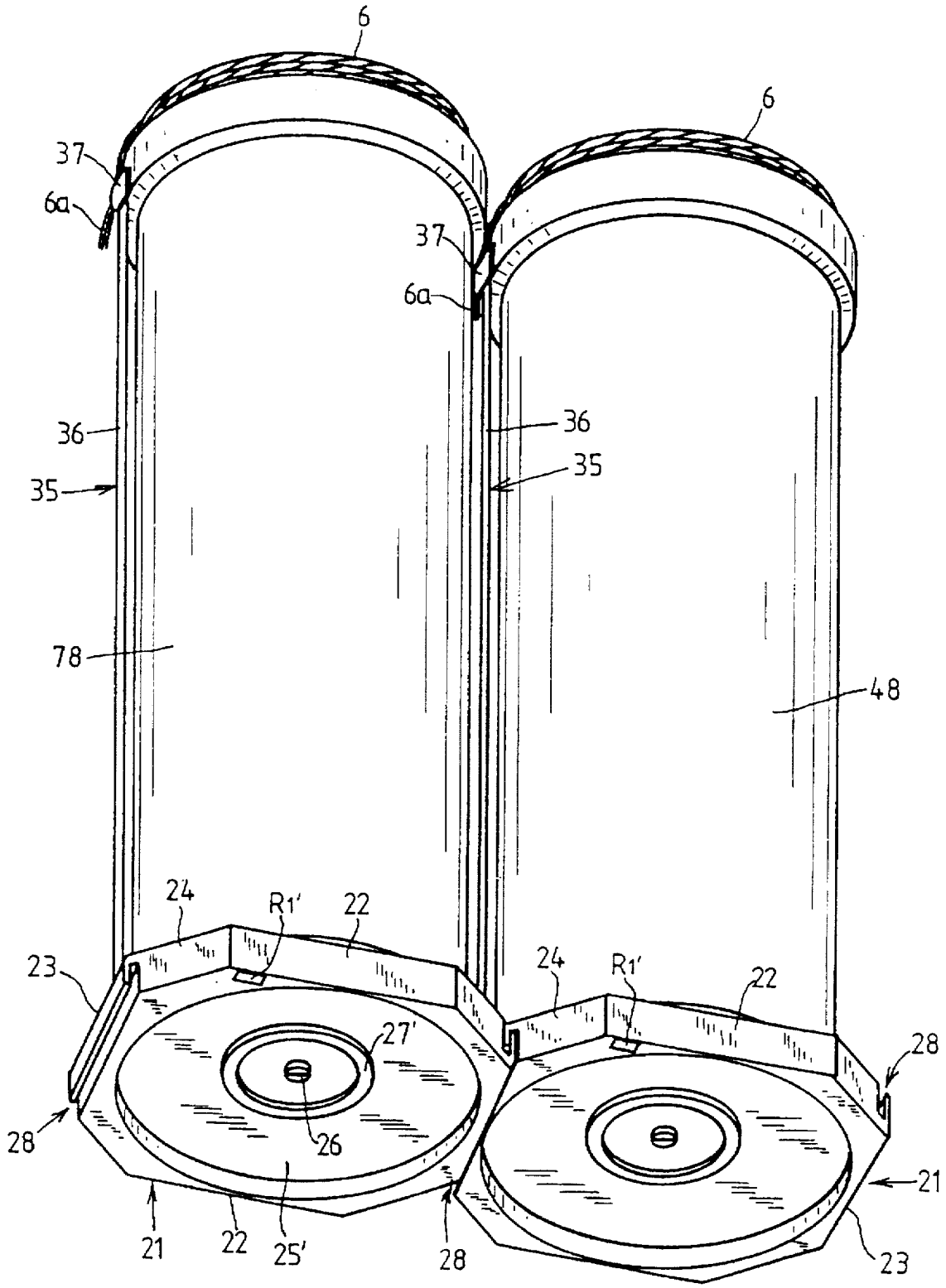
FIG. 5 is a perspective view of two coupled pallets with cans.

In each case, one bore 34 is formed in each of the short sides 23 of the pallet, centrally in the region of the groove 29 of the gripper claws 28. This bore 34 serves to secure a yarn clamp 35 to the pallet, if the can itself lacks a yarn clamp. In FIG. 1 and FIG. 5, the disposition of the yarn clamps 35 on the pallets 21 can be seen. FIGS. 4 and 4*a* show details of a yarn clamp. A yarn clamp 35 includes a bar 36 that has a clamp 37, into which the sliver 6 can be inserted easily with a starting end 6*a* thereof and from which it can be removed again. The bar 36 has a base 38 which is inserted into the bore 34 and screwed to the pallet there with a screw 39, as FIG. 4 shows. The level at which the clamp 37 is disposed depends on the disposition of the gripper apparatus of the automatic sliver inserter. After a clamp screw 37*a* has been loosened, the clamp can be shifted on the bar 36, and its position can thus be adapted to the sliver inserter. Placing the yarn clamp 35 on one short side 23 in the region of the downward-pointing gripper claw 28 always assures a precisely defined position of the starting end 6*a* of the sliver when the sliver cans are changed.

As is seen in FIG. 1, in order to set down the cans with their pallets at the spinning stations of the spinning machine, it suffices to place T-shaped angle profile sections 40, which are set upside down, below the spinning stations. The profile sections 40 enable easy guidance of the pallets upon can removal and insertion. These profile sections are disposed at a height above a floor 41 in such a way that the changer mechanism of the can transport vehicle 2 can remove the cans and insert them without difficulty.

Figure 6:
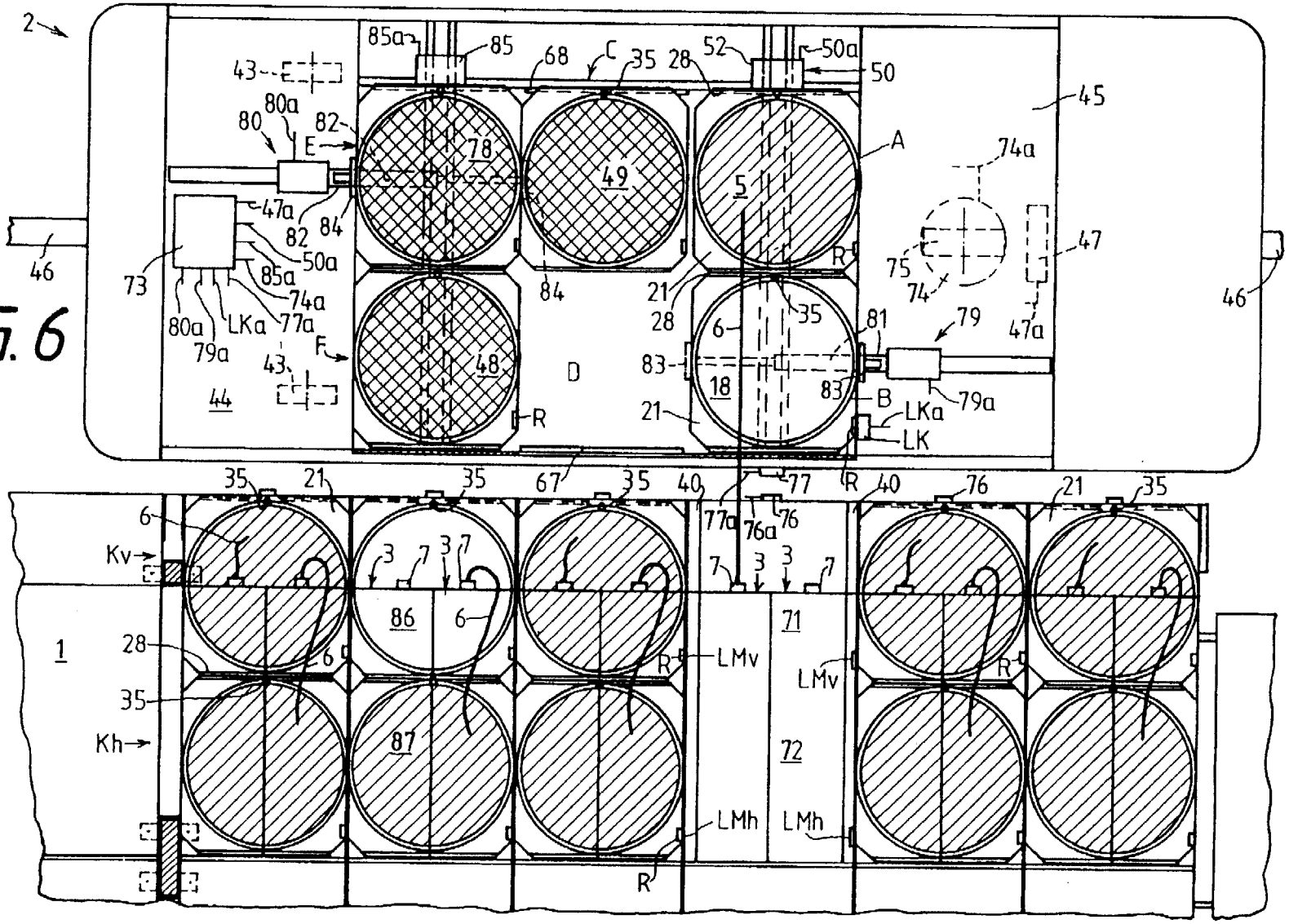
FIG. 6 is a fragmentary, plan view of a can transport vehicle in the can changing position in front of a work station.

The can transport vehicle 2, which is particularly seen in FIGS. 1 and 6, includes an undercarriage 42 with wheels 43. The vehicle has a rectangular outline. The vehicle 2 has one short side on which its undercarriage 42 carries a drive portion 45 with a motor 74 seen in FIG. 6, that drives a steerable wheel 75. The vehicle 2 has an opposite short side seen in FIG. 6 on which it carries a control portion 44 with a control unit 73 that processes control commands and controls the can changing.

The can transport vehicle 2 is guided along the spinning machine 1 by means of an induction loop 46, and from there it is guided to a non-illustrated discharge station for the empty cans, to a can delivery station that furnishes filled sliver cans, and optionally to other non-illustrated spinning machines. However, the transmission of control commands by radio signals or by light signals in the infrared range is also conceivable. In the present exemplary embodiment, the commands of the induction loop 46 are received by a receiver 47, which is located beneath the undercarriage 42 facing toward the floor 41. The control commands are carried to the control unit 73, where they are evaluated and used to control the course of work performed by the can transport vehicle 2.

In the present exemplary embodiment, the can transport vehicle 2 has four parking places seen in FIG. 6. In FIG. 1, two of the cans 48 and 49 that are carried along with the vehicle can be seen. In FIG. 1, the can transport vehicle 2 is sectioned in the region of a can changer mechanism 50 thereof. The layout of the can changer mechanism is essentially equivalent to the embodiment shown and described in German Published, Non-Prosecuted Application DE 43 23 726 A1, corresponding to U.S. application Ser. No. 08/276, 168, filed Jul. 15, 1994. The can changer mechanism 50 rests on the undercarriage 42, which is shown in section in this case. The can changer mechanism 50 substantially includes a sled 51, which is displaceable relative to the undercarriage at right angles to the longitudinal axis of the vehicle, in the direction of the spinning stations, and it also includes an apparatus 52 for displacing a pallet with a can, or two coupled-together pallets, and for setting down the pallets from the sled 51 and receiving one or two coupled pallets on the sled 51. The displacement of the sled 51 is carried out by means of a toothed belt 53. This toothed belt travels around a driven deflection roller 54, which is permanently connected to the undercarriage 42 and is driven by a motor 55 through a gear 56. The toothed belt 53 is guided around a further deflection roller 57 that is secured to the undercarriage 42. The sled 51 is connected to the toothed belt 53 by a clamp 58.

The sled 51 has one deflection roller 59 and one deflection roller 60 which are respectively disposed toward the right and the left of an end thereof. A toothed belt 61 is wrapped around these two deflection rollers 59 and 60. As viewed in an outward-thrust direction 62 of the sled 51, a fastener 63 for securing the toothed belt 61 to the undercarriage 42 is located just before the deflection roller 57. The toothed belt 61 is part of the apparatus 52 for displacing a pallet on the sled 51. To that end, the apparatus 52 also includes means 64 for handling a pallet. The means 64 are slidingly supported on the sled 51 and, is as indicated by reference numeral 65, the means 64 are permanently connected to the toothed belt 61. In the present exemplary embodiment, the means 64 for handling a pallet are a hook that can be swiveled about a horizontal axis. The hook 64 engages the groove 29 of the gripper claw 28 of the pallet 21, on which the sliver can 5 is located below the spinning station 3. Upon moving beneath the gripper claw 28, the hook 64 is folded down by the apparatus 52 for displacing a pallet, or else it deflects by spring force, until it has engaged the rib 30 from behind. The apparatus 52 for displacing a pallet is then capable of pulling the engaged pallet onto the can transport vehicle. If pallets are to be pushed downward from the can transport vehicle, then a stop edge 66 of the apparatus 52 suffices to shift the pallets, for instance beneath the spinning stations of a spinning machine. Once the pallets have been set down at the intended location, the hook 64 is folded downward by the apparatus 52, so that the rib 30 of the gripper claw 28 is released. After that, the sled 51 can be retracted.

The mode of operation of the can changer mechanism 50 has been described in detail in German Published, Non-Prosecuted Application DE 43 23 726 A1, corresponding to U.S. application Ser. No. 08/276,168, filed Jul. 15, 1994. If the sled 51 is moved outward through the motor 55 by means of the toothed belt 53, then the toothed belt 61 secured to the undercarriage 42 forces the deflection rollers 59 and 60 to rotate. As a result, the sled 51 is displaced relative to the toothed belt 61, and the apparatus 52 for displacing a pallet is carried along with the toothed belt as far as the end of the sled 51 in the fully extended position thereof. When the sled is retracted, the toothed belt 61 rotates in the opposite direction and in the process carries the apparatus 52 with it, so that once the sled 51 has been fully retracted, the apparatus 52 is likewise in its original position.

Respective guide rails 67 and 68 can be seen on the can transport vehicle 2 on the left of the pallet 21 having the can 48 and on the right of the pallet 21 having the can 49. These guide rails engage the gripper claws 28 of the pallets. They enable displacement of the pallets longitudinally of the can transport vehicle, by means of non-illustrated thrust cylinders. These thrust cylinders are shown in FIG. 6, and their function is described in conjunction with the description of FIG. 6.

In FIG. 1, the contour of a service vehicle 69, for instance a piecer cart, is shown in front of the spinning station 3. After the sliver cans have been changed, insertion of the starting end of the sliver into the condenser 7 of the spinning station having a can which has been changed, is performed by means of a sliver inserter 70 mounted on the piecer cart. The structure of this sliver inserter 70 will not be described in further detail herein, because such a device is already known from German Published, Non-Prosecuted Application DE 42 04 044 A1, corresponding to U.S. Pat. No. 5,293,739. After the sliver has been inserted into the spinning station condenser, feeding of the sliver, which is carried out by the piecer cart, and piecing of the yarn, are performed in the way which is known from the prior art.

The process of a can change will be explained in conjunction with FIGS. 6–8, both for replacement of a can that has run empty in the back row and of a can that has run empty in the front row.

In FIG. 6, the can transport vehicle 2 has positioned itself in front of a spinning station having a sliver can which has run empty, so as to replace it with a filled sliver can.

Only the contours of the side-by-side spinning stations 3 of the open-end spinning machine are shown, as represented by their condensers 7. Below the spinning stations 3, the sliver cans are set up in a double row, having a front row of cans Kv and a rear row of cans Kh. As can be seen from the drawing, each can has a diameter that is approximately equivalent to the width of two spinning stations side by side. Each can drawn with shading is filled with sliver, and from it sliver 6 is drawn into the condenser 7 of the associated spinning station. The sliver is drawn into two adjacent spinning stations at a time, with the two stations being covered by one can width and each having one front can and one rear can associated with them. The cans that are not shown with shading are cans that have run empty.

The cans are each located on their pallets 21, and one can of the front row Kv and one can of the rear row Kh of cans are form-lockingly connected to one another by means of their gripper claws 28. One front can and one back can thus each rest on the T-shaped profile sections 40 mounted below the spinning stations, in such a way that the cans can be pulled out toward the front of the spinning machine. Reference numerals 71 and 72 indicate two positions of cans in the back row, which are below two spinning stations and side by side. The cans that were in the positions 71 and 72 have just been pulled onto the can transport vehicle. The profile sections 40 which are carried by the pallets 21 of the cans disposed below the spinning stations can be seen beneath the two side by side spinning stations.

The can transport vehicle 2 has been called to the open-end spinning machine 1 in order to replace the empty can 18 with a freshly filled sliver can, as is shown in FIG. 1. The request is made through a call system, for instance by means of infrared signals, through a transmitting and receiving system for wireless signal transmission, or as in the present exemplary embodiment through the induction loop 46. The signals originating in the induction loop 46 are received by the receiver 47 disposed on the can transport vehicle 2 and carried over a signal line **47*a* to the control unit 73 accommodated in the control portion 44. The control unit 73 also controls the drive motor 74 which drives the steerable drive wheel 75, over a signal line 74*a*. The positioning of the can transport vehicle 2 is carried out by means of a transmitter-receiver system 76, 77**, which is already known from the prior art, with one example being German Published, Non-Prosecuted Application DE 38 41 464 A1.

In the present exemplary embodiment, there is one call and data exchange device 76 provided for each of two side-by-side spinning stations, having sliver cans which are disposed one behind the other below these spinning stations. The device 76 exchanges its signals, over a signal line 76*a*, with a non-illustrated higher-ranking control unit belonging to the machine itself or the spinning station itself. The can transport vehicle 2 includes a comparable system 77 for positioning and for data exchange, which is in communication with the control unit 73 of the can transport vehicle over a signal line 77*a*.

As can be seen from FIG. 6, through the use of the can changer mechanism 50, the can transport vehicle 2 has already pulled the empty can 18 and the can 5 that is still furnishing sliver 6 to the front by their pallets 21 disposed under the spinning stations 3, onto the can transport vehicle. This has created the two empty places 71 and 72 which are located one behind the other, at the open-end spinning machine. The apparatus 52 for displacing the pallet has pulled the can 5 which is still furnishing sliver 6 to a spinning station, as well as the empty can 18, onto the can transport vehicle 2 and into a can changing position A, as the hook 64 which is seen in FIG. 1 but is not visible in this case, snaps into engagement with the gripper claw 28 of the pallet 21. Since the pallet 21 of the empty can 18 is form-lockingly connected to the pallet 21 of the can 5 through the gripper claw 28, the empty can 18 is likewise pulled onto the can transport vehicle, specifically to a changing position B.

Since each pallet 21 has a random access memory at a precisely defined point, an exchange of information, both with the machine and with the can transport vehicle, is possible upon a can change. In the present exemplary embodiment, a reading and writing head is disposed at each can parking place, at the level of the location of the RAM R on the pallet.

Reading and writing heads LMv are disposed at the can parking places of the front row of cans Kv at each can location on the open-end spinning machine 1, and reading and writing heads LMh are disposed at each can location in the rear row Kh of cans, as can be seen for the can parking places 71 and 72 where the cans have already been removed.

One reading and writing head LK is located wherever the can changer mechanism 50 is disposed on the can transport vehicle 2. When the cans are pulled in and pushed out, the RAMs R move on the pallets 21 past the reading and writing head LK. The information output to the RAMs R by the spinning stations can be read out in the process when the cans are pulled onto the can transport vehicle. Conversely, all of the information imparted to the cans during filling at the filling stations can be read by the reading and writing head LK of the can transport vehicle. In addition, with the aid of the reading and writing heads, the supply of cans on the can transport vehicle at any given time can be checked, and each changing operation can be recorded and passed on to the appropriate memories or control unit. The reading and writing head LK thus communicates through its signal line LKa with the control unit 73 on the can transport vehicle. The reading and writing heads LMv and LMh communicate over non-illustrated signal lines with the control unit of the applicable spinning station, or through a computer located at that spinning station with a central computer of the spinning machine 1.

The random access memories R enable the storage in memory of all of the data which are relevant for the spinning process, with examples being the data imparted at the filling station with respect to the fill quantity, the fiber type of the batch, the color, the associated spinning machine, and possibly even the associated spinning station in the spinning machine. On the basis of this information, the can transport vehicle can travel directly to the spinning station of the appropriate spinning machine, and when the can is set down the can transport vehicle records which can was changed. At the can parking place below the spinning stations, the information from the RAM R can be read by the reading and writing heads LMv and LMh and imparted to the spinning station, or in other words to the spinning station computer and therefore to the central computer of the spinning machine. On the other hand, when the can leaves the spinning station, information for the can transport vehicle is written into the memory on the can, so that from that information the can transport vehicle can deliver the can to the filling station associated with that can. The position of the can at a given time can also be noted in the RAM R, along with the spinning station associated with it. As will be described below, can changing of an empty can in the rear row of cans Kh especially runs the danger of mistakes in the locations of the cans. In order to ensure that the can transport vehicle will always change the can that has run empty, the change of location is also stored in memory in the RAM R. As a result, upon demand from a spinning station, the can transport vehicle is capable of changing the sliver can that is actually associated with a spinning station and has run empty, even if a change of location of cans below the two spinning stations has occurred as a result of a previous changing operation.

The can transport vehicle of the present exemplary embodiment has six can parking places, of which two, that is the parking places A and B on the can changer mechanism 50, are occupied only during a can changing operation. After loading at a can filling station, freshly filled sliver cans, of which the sliver cans 48 and 49 can be seen in FIG. 1, are located at parking places C, E and F. The sliver can 49 is located on the can parking place C, while the sliver can 48 is located on the can parking place F. A can parking place D which is also located in front of the can parking place F must remain empty for the can changing operation described below. A can 78 that is freshly filled with sliver is located on the can parking place E, but is not visible in FIG. 1. Cans that are freshly filled with sliver are indicated by cross-hatching in the drawing.

The can transport vehicle differs in its construction from can transport vehicles that were known until now, for reasons of handling of the cans on the pallets. Only the can changer mechanism 50 of the present exemplary embodiment is comparable to the can changer mechanism of German Published, Non-Prosecuted Application DE 43 23 726 A1, corresponding to U.S. application Ser. No. 08/276, 168, filed Jul. 15, 1994. Since the cans in the row Kv are joined together form-lockingly with the cans in the row Kh through the gripper claws 28, both of these cans are always pulled jointly onto the can transport vehicle by means of the can changer mechanism 50. On the can transport vehicle 2, the cans are displaced by so-called crosswise pushers 79 and 80. The crosswise pushers are hydraulic cylinders, having respective pistons 81 and 82 which can be split apart in telescoping fashion. Each piston has a respective thrust plate 83 and 84 on its end surface. The crosswise pusher 79 is disposed in the drive device 45 and is capable of displacing cans from position B to positions D and F of the can transport vehicle. The crosswise pusher 80 is accommodated in the control portion 44 of the can transport vehicle and can displace cans from the parking place E to the parking places C or A. If the parking places C and E are occupied by cans, it is also capable of simultaneously and jointly displacing the can on the parking place C to the position A and the can on the parking place E to the position C. During the displacement between the positions B, D and F, on one hand, and E, C and A, on the other hand, the pallets are guided one under the other because of the form-locking meshing of their gripper claws 28 and are guided in the can transport vehicle by engagement of the gripper claws 28 with the respective guide rails 67 and 68.

The displacement of the cans between the positions E and F, on one hand, and F and E, on the other hand, is carried out by means of a displacement mechanism 85, which is comparable in its layout to the can changer mechanism 50.

A can changing operation will be explained below in conjunction with FIG. 7. In this operation, as is already shown in FIGS. 1 and 6, a can that has run empty in the back row Kh, which in the present case is the can 18, will be changed.

A part a) of FIG. 7 shows the situation at the outset, which is also shown in FIG. 1. The can transport vehicle 2, which is symbolically represented by the six parking places A–F, is opposite the spinning machine 1, which is symbolized by the spinning stations 3. The can transport vehicle 2 has retrieved three cans 48, 49 and 78, which are freshly filled with sliver, from a non-illustrated can filling station. The can parking places A and B on the can changer mechanism have remained free, and the parking place D is also unoccupied. The empty can 18, which is to be changed, is located in the back row Kh of cans. In front of it is a sliver can 5, from which sliver 6 is still being drawn into the condenser 7 of a spinning station 3. The can changer mechanism 50 is extended, and it pulls the pallets of the cans 5 and 18, which are joined together through the gripper claws 28, in the direction of the arrow onto the can transport vehicle 2, by placing the can 5 on the parking place A and the can 18 on the parking place B. This situation is shown both in FIG. 6 and in a part b) of FIG. 7. The can parking place 71 has thus been created at the place where the can 5 was located, beneath the spinning station 3, and the empty parking place 72 is located where the empty can 18 stood.

In the part b) of FIG. 7, a reordering of cans on the can transport vehicle 2 is suggested. With the aid of the crosswise pusher 79, the can 18 is displaced in the direction of the arrow onto the still-empty can parking place D. Through the use of the can changer mechanism 50, the can 5 that is still furnishing sliver is displaced in the direction of the arrow onto the can parking place B.

The resultant situation is shown in a part c) of FIG. 7. In the part c) of FIG. 7, the displacement of cans 49 and 78 from their respective positions C and E to the positions A and C by means of the crosswise pusher 80 is also suggested. The can 48 is then displaced in accordance with the direction of the arrow from the parking place F onto the parking place E which was left empty when the can 78 was moved, by means of the displacement mechanism 85. The empty can 18 is then displaced onto the then-empty parking place E by means of the crosswise pusher 79.

Once this reordering has been carried out, the positions of the cans are as is shown in a part d) of FIG. 7. In the part d) of FIG. 7, the full can 49 has been displaced onto the parking place A that was still empty in the part c) of FIG. 7. The can 5 that is still furnishing sliver and the freshly filled can 49 are then displaced jointly by means of the can changer mechanism 50 to beneath the spinning stations of the spinning machine 1, as is indicated by the arrow. In the process, the can 5 changes its position from the row Kv to the row Kh. According to the invention, the position on the formerly empty place 71 is taken by the sliver can 49. After a can change, the can having sliver which must be inserted at a spinning station is always located in the front row Kv. This enables automatic insertion of the sliver. In order for the sliver inserter 70 to know which spinning station it is supposed to insert the sliver into at that time, the change of position of the sliver can 5 is recorded at the reading and writing head LK when the sliver cans leave the can transport vehicle 2, when the RAM R on the pallet 21 moves past the sliver can 5. The can location change can also be ascertained at the reading and writing heads LMv and LMh at the respective parking places 71 and 72. Through the use of the corresponding signal lines and control units, the piecer cart 69 then receives the command to position itself in such a way that the sliver of the freshly changed sliver can 49 is inserted by the sliver inserter 70 at the spinning station where the can 18 ran empty.

A part e) of FIG. 7 shows the situation for the spinning machine 1 and the can transport vehicle 2 after the change of an empty sliver can in the back row Kh of cans and piecing of the sliver have been completed.

A can change of an empty sliver can in the front row Kv of cans will be explained below in conjunction with parts a) to e) of FIG. 8.

In the part a) of FIG. 8*a*, the can transport vehicle 2 has positioned itself in front of the spinning station where a sliver can 86 in the front row Kv of cans has run empty. A sliver can 87 positioned behind the sliver can 86 in the can row Kh is still furnishing sliver 6 to the condenser 7 of the adjacent spinning station. This situation can also be seen in FIG. 6. However, in FIG. 8 the can transport vehicle is not positioned in front of the corresponding spinning stations in such a way that a can change could be performed. One way in which a can change could be made from the same position of the can transport vehicle would be if the displacement mechanism 85 were equivalent to the can changer mechanism 50, and if a further positioning system were provided that would enable positioning of the can transport vehicle for the second can changer mechanism as well. However, in that case it would not be possible, as is evidently possible in FIG. 6, to perform a can change simultaneously at two different spinning stations. The empty position D is always needed for a can changing operation, so that the cans can be reordered on the can transport vehicle.

In the present exemplary embodiment, in the parts a) to e) of FIG. 8, the can transport vehicle 2 carries three freshly filled sliver cans 88, 89 and 90. Once again, as in the previous exemplary embodiment, the can parking places A, B and D on the can transport vehicle 2 are unoccupied.

In the part a) of FIG. 8, the can changer mechanism 50 has already engaged the pallets of the two sliver cans 86 and 87 and is pulling them onto the can transport vehicle 2.

However, in contrast to the previous exemplary embodiment, the can changer mechanism pulls only the empty sliver can 86 into a position such that it comes to rest on the can parking place B, as is shown in the part b) of FIG. 8. The crosswise pusher 79 then goes into operation and displaces the empty sliver can 86 into the free can parking place D. This is also indicated by an arrow. After that, the crosswise pusher 79 retracts, and the can changer mechanism 50 displaces the can 87 that is still furnishing sliver into the position B. This situation is shown in the part c) of FIG. 8.

The reordering of the sliver cans on the can transport vehicle 2 is also shown in the part c) of FIG. 8. First the crosswise pusher 80 goes into action and displaces the sliver cans 88 and 89 from their respective places C and E into the can parking places A and C. The sliver can 90 is displaced from the position F onto the then-free can parking place E by the displacement mechanism 85. The empty sliver can 86 is then displaced by the crosswise pusher 79 into the position F that had become empty. After that, all of the crosswise pushers and the displacement mechanisms return to their original positions.

After the reordering of the sliver cans, they are in the positions shown in the part d) of FIG. 8. In the part d) of FIG. 8, the filled sliver cans 88, 89 and 90 are in one row on the can parking places A, C and E, respectively. The can changer mechanism 50 then comes into action again and displaces the sliver cans 87 and 88 from the respective positions B and A to underneath the spinning stations. The sliver can 87 is returned to its old place in the process, and the freshly filled sliver can 88 takes the place that the empty can 86 had previously occupied.

As was already explained for the previous exemplary embodiment, the can changing operations are ascertained and imparted to the appropriate control units by the reading and writing heads LK on the can transport vehicle 2, the reading and writing heads LMv at the parking place in the front row Kv of cans, and the reading and writing head LMh at the parking place of the rear row Kh of cans. After that, in this last-described can changing operation as well, the sliver inserter is capable of inserting the sliver from the can 88 into the associated spinning station. Once the above-described can change has been carried out, the can transport vehicle is ready for use in making a further can change.

From the last-described course of a can change, it is apparent that no special aids are required in order to orient the sliver clamp 35 with the starting end of the sliver that is ready for sliver insertion. If the can transport vehicle 2 arrives from a discharge station for filled sliver cans, all of the sliver cans are oriented in a certain direction, so that the sliver clamps 35, which are associated with a preferred short side of the cans, are likewise oriented. If the starting end of the sliver is to be insertable by an automatic sliver inserter at the spinning stations, the sliver clamps 35 must each be located on the sides of the cans facing away from the spinning stations when they arrive at the spinning machine 1 and as the can transport vehicle 2 moves past the spinning stations. Through the use of the pallets, this direction is specified and is always adhered to. In the reordering of cans on the can transport vehicle, a displacement of the cans takes place at right angles or parallel to one another as applicable. This assures that the sliver clamps can no longer change their position once specified, since no pallet undergoes a rotary motion at right angles to the recesses 25 and 25' for a parking surface of a can standing on it.

Figure 9:
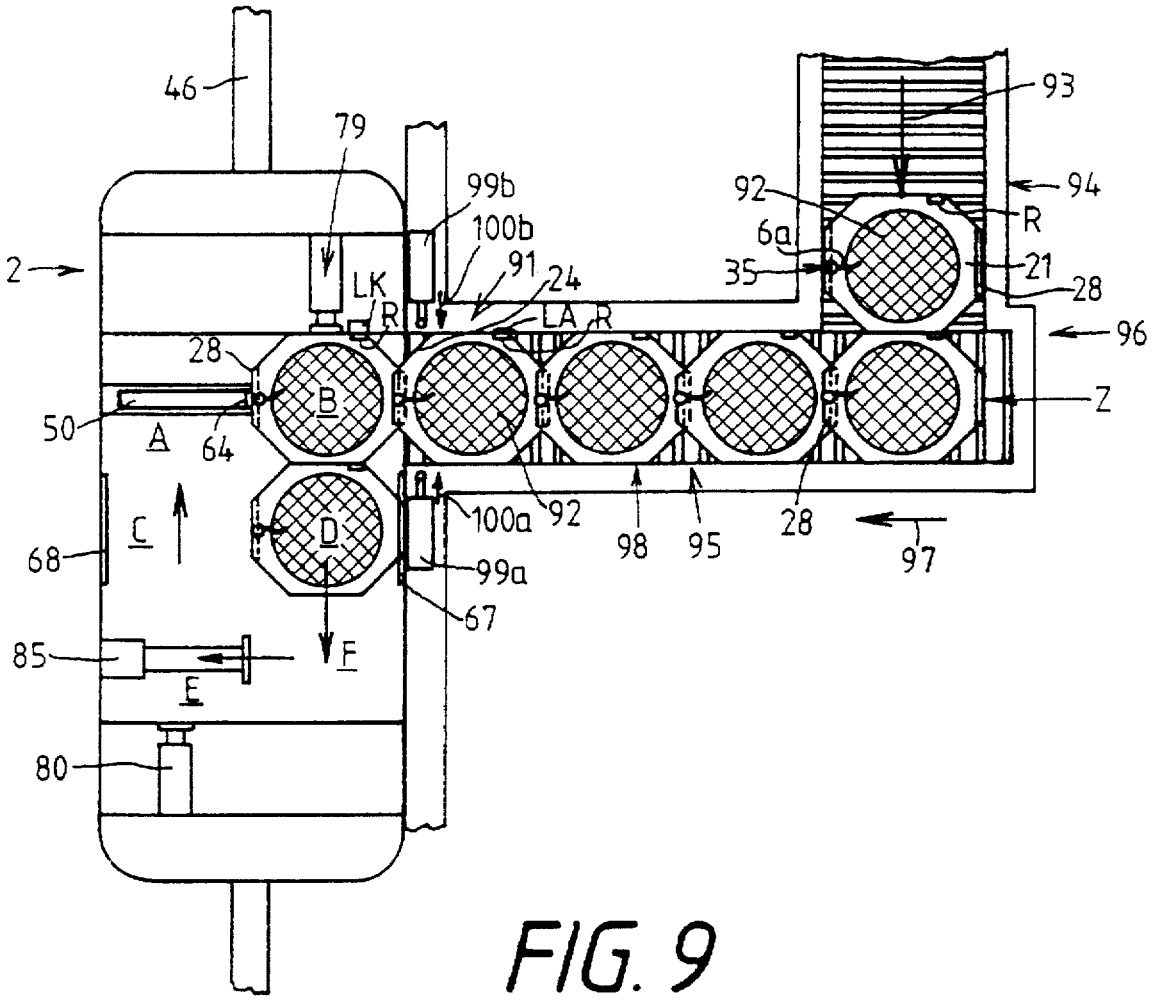
FIG. 9 is a fragmentary, plan view illustrating a loading operation at a discharge station for filled sliver cans.

FIG. 9 diagrammatically shows an exemplary embodiment of a way in which the pallets can be coupled together by means of their gripper claws into trains that are transportable on transport devices. FIG. 9 diagrammatically shows the loading of a can transport vehicle 2 at a discharge station 91 for filled sliver cans 92. The freshly filled sliver cans 92 are automatically transported from a non-illustrated filling station in the direction of an arrow 93 by a transport device 94, which in this case is an inclined roller track, to a roller track 95 that is disposed at a right angle to it and has no gradient and no drive device. At a transfer point 96 from the roller track 94 to the roller track 95, a change in direction of can transport is provided. The cans are drawn off in the direction of an arrow 97, at a right angle to the conveying direction 93. The cans 92 each stand on a pallet 21, and the starting end 6a of the sliver is ready, in a yarn clamp 35, for automatic transfer of the starting end of the sliver to a work station. The sliver cans which are brought from the non-illustrated filling station all have the same alignment on the conveying apparatus 94, because of the disposition of the yarn clamp 35. Since the pallets are equipped with gripper claws 28 on their short sides and are transported with these gripper claws at right angles to the conveying direction 93, upon transfer to the roller track 95 these gripper claws 28 engage the gripper claws of the pallets that are already located on that roller track. In order to accomplish this, a developing pallet train 98 is advanced in increments upon the transfer of a sliver can to the can transport vehicle 2. This occurs only just long enough each time to ensure that a following pallet with its gripper claw engages the gripper claw of the pallet that is already ready.

A can transport vehicle has positioned itself at the discharge station 91 in such a way that the can changer mechanism 50 can take over the pallets that are ready on the roller track 95. Through the use of the hook 64 as its means for handling a pallet, it engages the gripper claw 28 of a pallet and pulls it far enough onto the can parking place B that the crosswise pusher 79, after uncoupling of the can changer mechanism 50, can push it onto the parking place D. After that, the can changer mechanism 50 moves onward one more time and pulls the next pallet, which is ready on the roller track 95 and carries a freshly filled sliver can, onto the parking place B of the can transport vehicle. Displacement of that can then follows as well, by means of the crosswise pusher 79, onto the parking place D. The can already located on the parking place D is displaced to the parking place F in the process. There, it is immediately engaged by the displacement mechanism 85 and pulled onto the parking place E. In the ensuing takeover of a can, the parking place F is likewise occupied, and the crosswise pusher 80 comes into action and displaces the can located there to the can parking place C. After the third sliver can that has been taken up, the takeover of cans is stopped, and the cans are ordered on the can transport vehicle in such a way that the parking places C, E and F are occupied. The can transport vehicle is thus equipped for a can change.

In order to ensure that the pallet that is first on the roller track 95 as a result of the takeover into the path of the can transport vehicle at the discharge station 91 will not impede the departure of the can transport vehicle 2, it is pushed back far enough by two pushers 99a and 99b, which act upon the diagonal edges 24 and move toward one another in opposed directions 100a and 100b, that the can transport vehicle 2 can depart without hindrance. To that end, it is controlled through the induction loop 46.

While pallets 21 with freshly filled sliver cans 92 can be taken from the roller path at the discharge station 91 during loading of the can transport vehicle 2, upon takeover of a pallet to the can parking place B, a pallet with a can can slide from the roller path 94 onto the roller path 95 to replace it. The gripper claw 28 of the next sliver can then engages the gripper claw of the sliver can that is already on the roller track 95. This assures that in the takeover of a sliver can onto the can transport vehicle 2, all of the pallets with sliver cans located on the roller track 95 will be advanced by the length of one pallet.

The apparatus presented in this case would also be conceivable for unloading of a can transport vehicle at a discharge station for empty cans. There, the can changer mechanism 50 would push the empty cans onto a conveyor belt, but because of the pushing, it would be unnecessary for the gripper claws of the individual pallets to mesh. Through the use of suitable provisions, such as a downward-sloping roller track, the pallets with the empty cans could be delivered to a filling station.

Since the pallets 21 are provided with encoding means, for instance a random access memory R, the cans can already be provided with information, for instance, at the can filling station. At the discharge station 91 for filled sliver cans, or at a discharge station for empty cans, although that is not shown, a reading and writing head, which is indicated by reference symbol LA in the present exemplary embodiment, may be disposed at the transfer point. In this case the number of cans taken on by a can transport vehicle 2, for instance, may be recorded. Through the use of the reading and writing head LK on the can transport vehicle 2, upon takeover of the sliver cans, it is possible to ascertain which machines these cans are to be transported to, and with which work stations they are to be associated there. It is also possible to ascertain what fiber material is located in the cans, and how large the filling quantity is. The encoding means on the pallets make it possible to track a sliver can uninterruptedly along with its content, from a can filling station all the way to discharge of the empty cans.

I claim:

1. In combination with a sliver-processing system having at least one sliver-processing textile machine with at least one work station, a discharge station for filled sliver cans, a discharge station for empty cans, and a transport path supporting the sliver cans on which the sliver cans commute back and forth between the discharge stations, a sliver can assembly comprising:

a sliver can formed with a cavity for receiving sliver having a starting end, said sliver can having a round cross section; and a polygonal pallet connected to said can, and said can defining a position for the starting sliver end which is fixed relative to said can and relative to said pallet for automatic insertion at the at least one work station.

2. The sliver can assembly according to claim 1, wherein the at least one sliver-processing textile machine has a parking place, and said pallet connected to said can is formed such that said pallet assumes a defined position on the parking place relative to the work station.

3. The sliver can assembly according to claim 1, wherein said pallet includes means which assure that said pallet always maintains defined positions of said sliver can relative to the insertion of the starting sliver end upon transfer from one position to another.

4. The sliver can assembly according to claim 1, wherein said sliver can is detachably connected to said pallet.

5. The sliver can assembly according to claim 1, wherein said pallet has a substantially rectangular outline.

6. The sliver can assembly according to claim 1, wherein said pallet has the shape of an equilateral polygon.

7. The sliver can assembly according to claim 1, including at least one other pallet, said pallets having means for form-lockingly interconnecting said pallets.

8. The sliver can assembly according to claim 7, wherein said pallets have two opposed sides, and said means for interconnecting said pallets are each disposed on a respective one of said two opposed sides.

9. The sliver can assembly according to claim 8, wherein said means for interconnecting said pallets each include a gripper claw with a hooklike cross section.

10. The sliver can assembly according to claim 9, wherein said gripper claws on said opposed sides of said pallet are oriented in opposite directions and are mirror symmetrical, and one of said gripper claws of one of said pallets can be brought into operative connection with one of said gripper claws of another of said pallets by fitting laterally into one another.

11. The sliver can assembly according to claim 1, wherein said pallet has upper and lower surfaces with mirror-symmetrical recesses formed therein.

12. The sliver can assembly according to claim 1, wherein said pallet has a retainer for the starting end of sliver filling said can standing on said pallet.

13. The sliver can assembly according to claim 1, wherein said pallet has encoding means.

14. The sliver can assembly according to claim 13, wherein said encoding means is a random access memory.

15. In combination with a sliver-processing system having at least one sliver-processing textile machine with at least one work station, a discharge station for filled sliver cans, a discharge station for empty cans and transfer places for cans, sliver cans with round cross sections and polygonal pallets connected to the cans, the cans and the pallets defining a position for a starting sliver end which is fixed relative to the can and relative to the pallet for automatic insertion at the at least one work station, a can changer for manipulating and transporting the sliver cans, comprising:

a can transport vehicle for transporting the sliver cans back and forth between the discharge station for filled sliver cans and the discharge station for empty sliver cans, said can transport vehicle having parking places for the sliver cans, a changer mechanism for replacing the cans at the work stations and the transfer places, and pushers for displacing the cans relative to one another on the parking places for reordering a configuration of the cans when the cans are picked up or delivered, the cans including means maintaining defined positions on the pallets relative to the insertion of the sliver upon transfer from one position to another.

16. The can changer according to claim 15, including read and/or write devices for reading and/or applying encoding means, being disposed at the transfer places for the cans on said transport vehicle and at the parking places for the cans at the work stations.

17. The can changer according to claim 15, including transport devices, the pallets having gripper claws for coupling the pallets together and transporting the coupled-together pallets on the transport devices.

* * * * *